US007688286B2

(12) United States Patent
Lee et al.

(10) Patent No.: US 7,688,286 B2
(45) Date of Patent: Mar. 30, 2010

(54) METHOD FOR REDUCING DYNAMIC FALSE CONTOUR ON PLASMA DISPLAY

(75) Inventors: Yu-Ju Lee, Taipei County (TW); Hsiang-Tan Lin, Keelung (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 972 days.

(21) Appl. No.: 11/164,857

(22) Filed: Dec. 8, 2005

(65) Prior Publication Data

US 2007/0132669 A1 Jun. 14, 2007

(51) Int. Cl.
*G09G 3/28* (2006.01)

(52) U.S. Cl. ..... 345/63; 345/690

(58) Field of Classification Search ..... 345/690, 345/37, 41, 60–68, 589, 166, 204; 348/29, 348/254, 671

See application file for complete search history.

(56) References Cited

U.S. PATENT DOCUMENTS 6,697,085 B2 * 2/2004 Lai et al. ..... 345/690

FOREIGN PATENT DOCUMENTS

| | | |
|---|---|---|
| CN | 1407521 | 4/2003 |
| JP | 10-161586 | 6/1998 |
| JP | 11-344953 | 12/1999 |

* cited by examiner

*Primary Examiner*—Regina Liang
(74) *Attorney, Agent, or Firm*—Jianq Chyun IP Office

(57) ABSTRACT

A method for reducing dynamic false contour on a plasma display is provided. The steps of the method are as follows. Firstly, determine a grayscale phase of a current pixel. And then change the grayscale phase of the current pixel if any one of the N pixels before the current pixel has the same grayscale value and the same grayscale phase as those of the current pixel, wherein N is an integer equal to or greater than 2. Finally, output the current pixel.

13 Claims, 6 Drawing Sheets

METHOD FOR REDUCING DYNAMIC FALSE CONTOUR ON PLASMA DISPLAY

BACKGROUND OF THE INVENTION

1. Field of the Invention

The present invention relates to a method for displaying images on a plasma display. More particularly, the present invention relates to a method for reducing dynamic false contour on a plasma display.

2. Description of the Related Art

Plasma display panels (PDP) utilize electron discharge of inert gases to produce ultraviolet rays to excite red, green and blue fluorescent powder in order to display images consisting of colored pixels. The appearance of PDP has a tremendous impact to the market of medium-sized and large-sized (about 40 to 70 inches) display. A plasma display is far thinner and lighter than a traditional cathode-ray tube (CRT) television. A plasma display is proof against magnetic field and also has many advantages, such as digital architecture, high resolution, wide viewing angels and flat display surface, which satisfies the requirements of small size and light weight of modern multimedia devices.

However, a problem called dynamic false contour usually happens when a PDP is displaying a dynamic image. A traditional solution is using two different grayscale phases, such as phases A and B, as depicted in FIGS. 1A and 1B. FIG. 1A illustrates phases A and B interweaved in a chess board pattern in the same frame field. FIG. 1B illustrates how phases A and B are interleaved in consecutive frame fields. Each cell of the matrices in FIG. 1A and FIG. 1B represents a pixel, such as the pixel P in FIG. 1A. "A" and "B" in FIGS. 1A and 1B are two different grayscale phases corresponding to the same grayscale value. For example, to implement the grayscale value of 64, 64 pulses are applied successively in phase A, while two batches of 32 pulses each are applied in phase B. Such solution in FIGS. 1A and 1B utilize interleaved phases. The phases are interleaved both spatially and temporally. That is, phases A and B are interleaved among the pixels in the same frame field, both horizontally and vertically (FIG. 1A), and are also interleaved between consecutive frame fields (FIG. 1B). The gray scale phases A and B are allocated in this way to evenly distribute visual focus. The dynamic false contours are therefore effectively reduced.

FIGS. 1A and 1B proposed a solution for reducing the dynamic false contour. However, during the development of a plasma display, test patterns are often used to test and verify whether the plasma display functions properly. The pixel lattice pattern, as shown in FIG. 2, is one of such test patterns. Each cell of the matrix in FIG. 2 represents a pixel. As can be seen in FIG. 2, in the pixel lattice pattern, all pixels immediately adjacent to an active pixel are inactive. The problem of flickering is especially obvious when the pixel lattice pattern is being displayed.

The reason why the problem of flickering is especially obvious when the pixel lattice pattern is being displayed is that there is a chance for the pixel lattice pattern to be synchronous with the interleave of the phases A and B. FIGS. 3A~3C illustrate the situation in which the pixel lattice pattern is synchronous with the interleave of the phases A and B. Each cell of the matrices in FIGS. 3A~3C represents a pixel. Please refer to FIGS. 3A~3C in the following discussions. FIG. 3A illustrates the first frame field, in which the pixel lattice pattern happens to be synchronous with phase A. FIG. 3B illustrates the second frame field, in which the pixel lattice pattern happens to be synchronous with phase B. And FIG. 3C illustrates successive frame fields which display the pixel lattice pattern and adopt the interleaved phases simultaneously. Due to the structure of the pixel lattice pattern, the active pixels in the first frame field are all in phase A, whereas the active pixels in the second frame field are all in phase B, and so on. Such a repeated occurrence is the major cause of the flickering problem.

SUMMARY OF THE INVENTION

Accordingly, the present invention is directed to a method for reducing dynamic false contour on a plasma display. The method is also capable of reducing flickering when the plasma display is showing certain images, such as the pixel lattice pattern.

According to an embodiment of the present invention, a method for reducing dynamic false contour on a plasma display is provided. The method comprises the following steps. Firstly, determine a grayscale phase of a current pixel. And then change the grayscale phase of the current pixel if any one of the N pixels before the current pixel has the same grayscale value and the same grayscale phase as those of the current pixel, wherein N is an integer equal to or greater than 2. Finally, output the current pixel.

In an embodiment of the present invention, the step of determining the grayscale phase of the current pixel further comprises the following steps. Firstly, use the first grayscale phase if the current pixel is the first pixel of the first frame field. Secondly, use a grayscale phase other than that of the first pixel of the previous frame field if the current pixel is the first pixel of a frame field other than the first frame field. And finally, use a grayscale phase other than that of the previous pixel if the current pixel is other than the first pixel of a frame field.

The method of the present invention automatically compares the grayscale phase and the grayscale value of the current pixel with those of the previous pixels, and conditionally changes the grayscale phase of the current pixel to interleave the grayscale phases of the pixels more effectively. As a result, the visual focus is balanced. The problem of dynamic false contour is alleviated. The flickering problem when the PDP is displaying certain images, such as the pixel lattice pattern, is also solved.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1A:
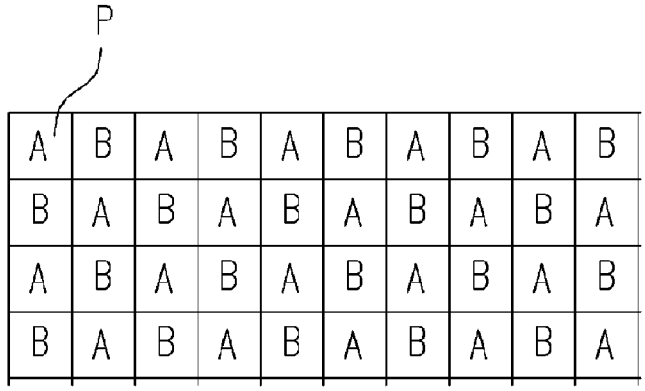
FIG. 1A (PRIOR ART)
FIGS. 1A and 1B are schematic diagrams showing the traditional method for reducing dynamic false contour.
Figure 1B:
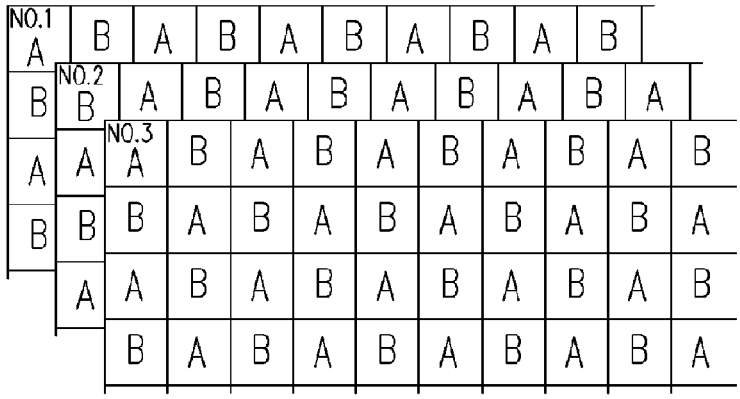
FIG. 1B (PRIOR ART)
Figure 2:
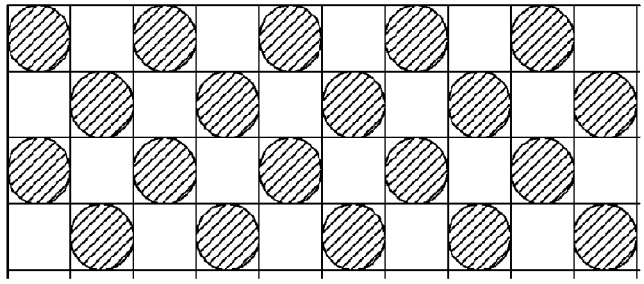
FIG. 2 is a schematic diagram showing the pixel lattice pattern used for testing a plasma display.
Figure 3A:
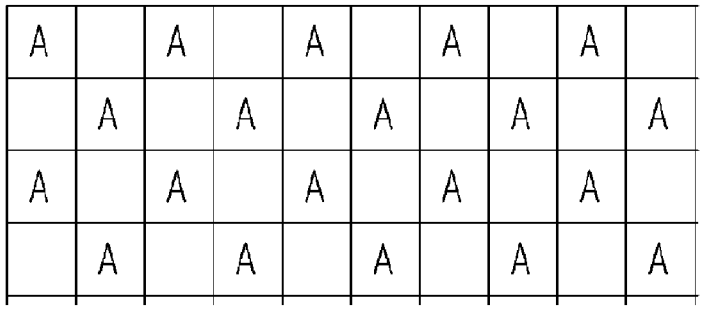
FIG. 3A (PRIOR ART)
FIGS. 3A~3C are schematic diagrams showing the traditional method for reducing dynamic false contour used on the pixel lattice pattern.
Figure 3B:
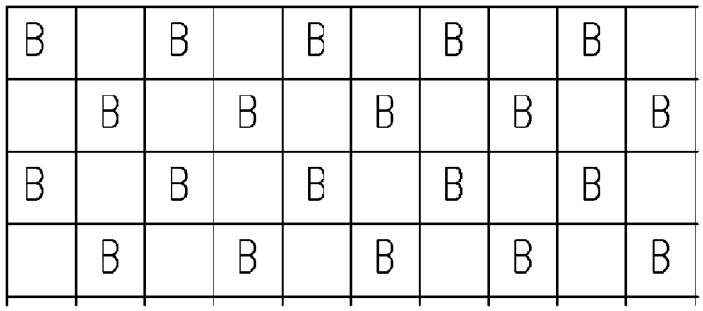
FIG. 3B (PRIOR ART)
Figure 3C:
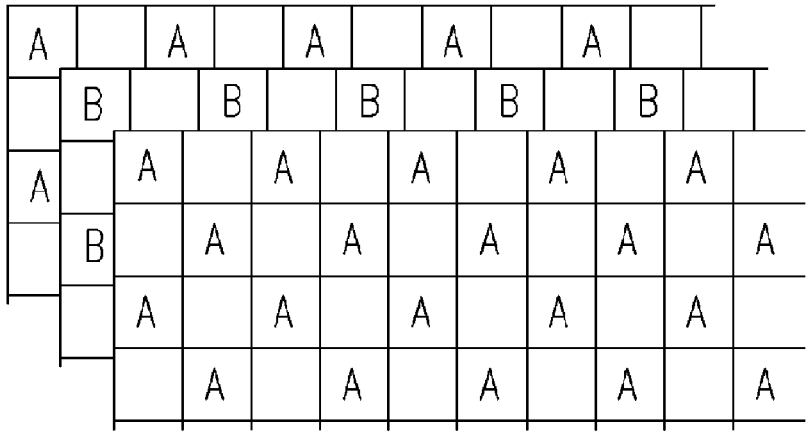
FIG. 3C (PRIOR ART)

Reference will now be made in detail to the present preferred embodiments of the invention, examples of which are illustrated in the accompanying drawings. Wherever possible, the same reference numbers are used in the drawings and the description to refer to the same or like parts.

Figure 4A:
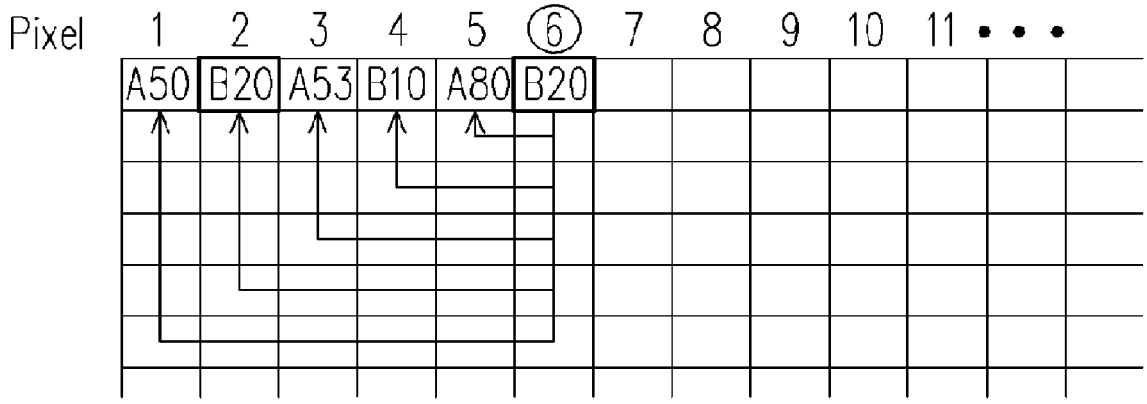
FIGS. 4A~4D are schematic diagrams showing an example of the method for reducing dynamic false contour on a plasma display according to an embodiment of the present invention.

In this embodiment, the method for reducing dynamic false contour on a plasma display of the present invention compares the grayscale value and the grayscale phase of every pixel inputted with those of the 5 previous pixels. Although this embodiment compares every pixel inputted with the 5 previous pixels, anyone skilled in the art should know that it is enough to compares every pixel inputted with at least the 2 previous pixels. If any one of the 5 previous pixels has the same grayscale value and the same grayscale phase as those of the current pixel, change the grayscale phase of the current pixel (for example, change from phase A to phase B, or change from phase B to phase A). Please refer to FIGS. 4A~4D, which shows an example of this embodiment. Each cell of the matrices in FIGS. 4A~4D represents a pixel. FIG. 4A illustrates 6 pixels in a frame field displayed by a PDP, which are shown as pixel 1 to pixel 6. The method in this embodiment is based on the interleaved phases A and B of the prior art. That is, pixel 1 is in phase A. Pixel 2 is in phase B. Pixel 3 is in phase A, and so on. Because pixel 5 is in phase A, pixel 6 (the current pixel) is in phase B when pixel 6 is initially inputted. Now assume the grayscale value of pixel 6 is 20. Therefore, pixel 6 is denoted as "B20", as shown in FIG. 4A.

Firstly, the method compares pixel 6 to pixel 5. The grayscale values of pixel 6 and pixel 5 are different, so the method proceeds to the next step. In the next step, the method compares pixel 6 to pixel 4. The grayscale values of pixel 6 and pixel 4 are also different, so the method proceeds to the next step. Similarly, in the next step, the method compares pixel 6 to pixel 3. The grayscale values of pixel 6 and pixel 3 are different, so the method proceeds to the next step. In the next step, the method compares pixel 6 to pixel 2. Pixel 6 and pixel 2 have the same grayscale value and the same grayscale phase. Therefore, the method changes the grayscale phase of pixel 6 from B to A and terminates the comparison. In other words, pixel 6 becomes "A20", as shown in FIG. 4B.

Figure 4B:
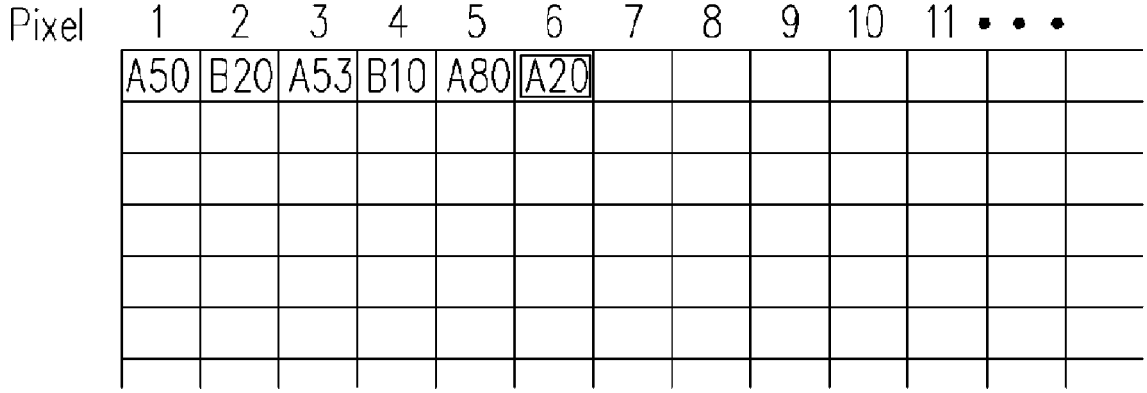
Figure 4C:
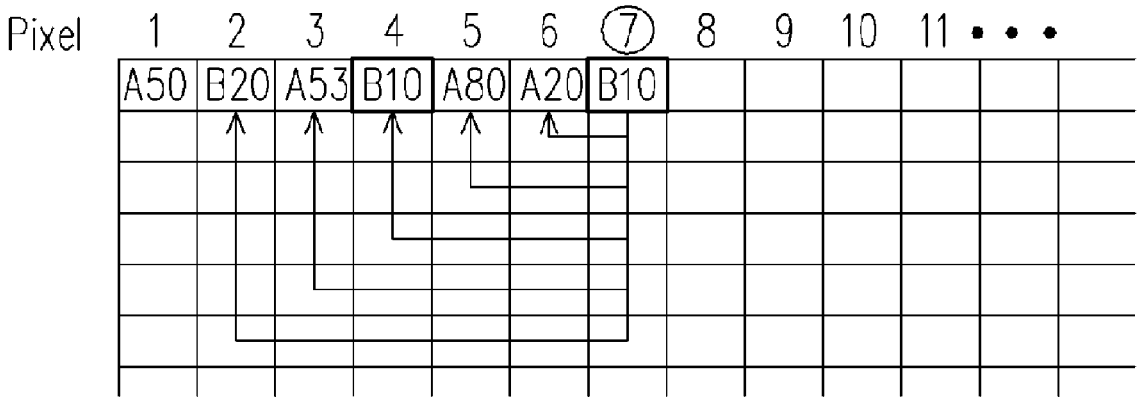
Figure 4D:
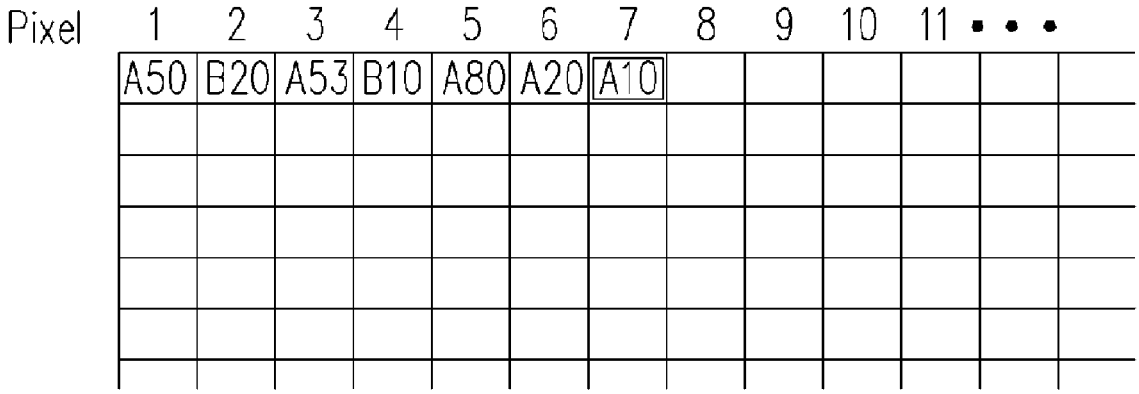

After the process of pixel 6, as depicted in FIGS. 4A and 4B, pixel 7 is processed in turn, as shown in FIG. 4C. Assume the grayscale value of pixel 7 is 10 and pixel 7 is in phase A. Because pixel 6 is changed from "B20" to "A20" in this embodiment, the initial phase of pixel 7 is B instead. The method compares pixel 7 to its 5 previous pixels in turn. Pixel 4 and pixel 7 has the same grayscale value 10 and the same grayscale phase B. As a result, the phase of pixel 7 is changed from B to A, as depicted in FIG. 4D.

Figure 5:
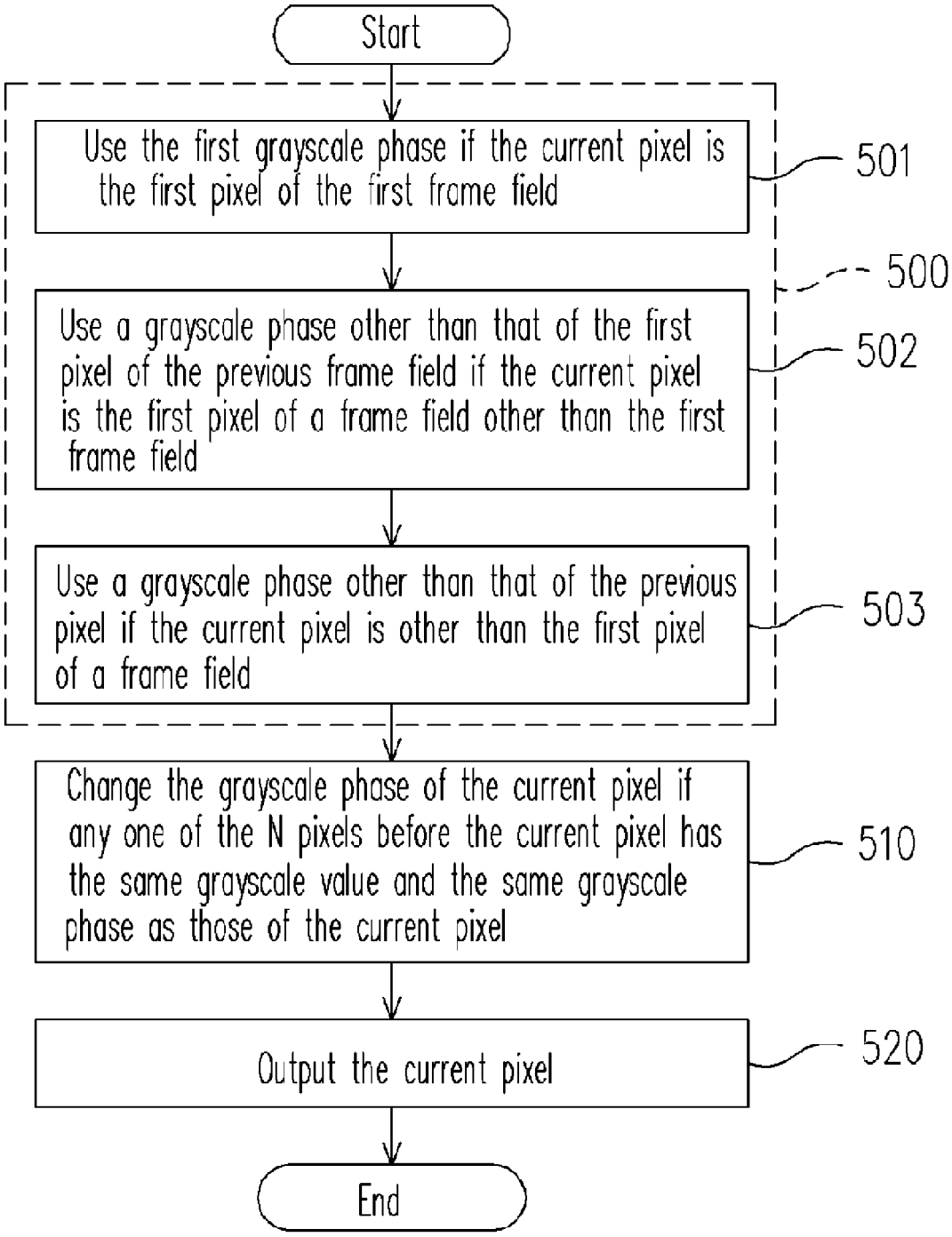
FIG. 5 is a flow chart of the method for reducing dynamic false contour on a plasma display according to an embodiment of the present invention.

The steps of the above embodiment can be expressed in more details as the flow in FIG. 5. Firstly, determine the initial grayscale phase of the current pixel (step 500). For example, use the first grayscale phase (for example, phase A) if the current pixel is the first pixel of the first frame field (step 501). Use a grayscale phase other than that of the first pixel of the previous frame field if the current pixel is the first pixel of a frame field other than the first frame field, for example, the first pixel of the second frame field, or the first pixel of the third frame field, and so on (step 502). Use a grayscale phase other than that of the previous pixel if the current pixel is other than the first pixel of a frame field, for example, the second pixel of a frame field, or the third pixel of a frame field, and so on (step 503). For example, if the previous pixel is in phase A, then choose B as the initial phase of the current pixel. After the initial phase is determined, change the grayscale phase of the current pixel if any one of the N pixels before the current pixel has the same grayscale value and the same grayscale phase as those of the current pixel (for example, FIGS. 4A~4D), wherein N is an integer equal to or greater than 2 (step 510). And finally, output the current pixel (step 520).

Figure 6:
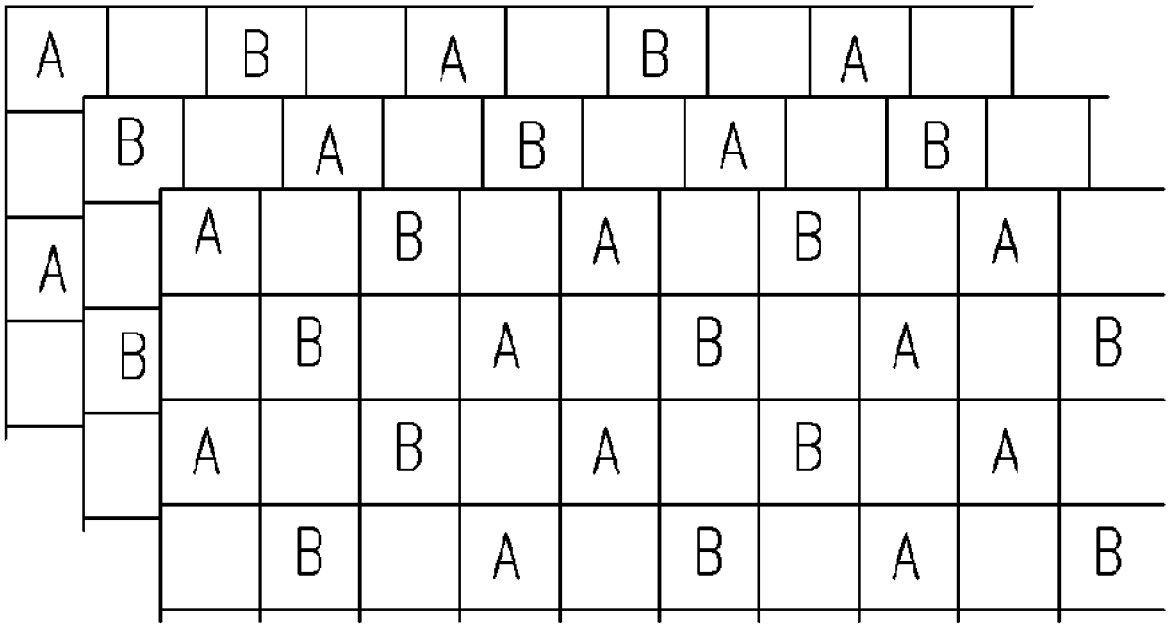
FIG. 6 is a schematic diagram showing an example of the method for reducing dynamic false contour on a plasma display according to an embodiment of the present invention used on the pixel lattice pattern.

FIG. 6 shows the method for reducing dynamic false contour on a plasma display according to an embodiment of the present invention applied on the pixel lattice pattern. As can be seen in FIG. 6, the method interleaves grayscale phases even in the pixel lattice pattern. If the first pixel is in phase A, the third pixel will be in phase B and the fifth pixel will be in phase A. The result is that the phases A and B are interleaved both spatially and temporally. Furthermore, the method is not limited to the pixel lattice pattern. The method can be applied to any image to compare and interleave the phases automatically. Therefore, the phases won't be interleaved according to fixed rules. And the flickering problem due to certain images can be solved.

As can be seen in the above discussion, the method of the present invention does not use the fixed interleave pattern of the prior art. Instead, the method automatically compares the grayscale phase and the grayscale value of the current pixel with those of the previous pixels, and conditionally changes the grayscale phase of the current pixel to interleave the grayscale phases of pixels more effectively. As a result, the visual focus is balanced. The problem of dynamic false contour is alleviated. The flickering problem when the PDP is displaying certain images, such as the pixel lattice pattern, is also solved.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A method for reducing dynamic false contour on a plasma display, executed by the plasma display, comprising:

determining a grayscale phase of a current pixel of the plasma display;

changing the grayscale phase of the current pixel if one of N pixels in the same row before the current pixel has the same grayscale value and the same grayscale phase as those of the current pixel, wherein N is an integer equal to or greater than 2; and outputting the current pixel on the plasma display.

2. The method of claim 1, wherein N is 5.

3. The method of claim 1, wherein the grayscale phases of the current pixel comprises a first grayscale phase and a second grayscale phase, and the method further comprises selecting one of the first grayscale phase and the second grayscale phase.

4. The method of claim 3, wherein the step of determining the grayscale phase of the current pixel comprises:

using the first grayscale phase if the current pixel is the first pixel of the first frame field;

using a grayscale phase other than that of the first pixel of the previous frame field if the current pixel is the first pixel of a frame field other than the first frame field; and using a grayscale phase other than that of the previous pixel if the current pixel is other than the first pixel of a frame field.

5. The method of claim 3, wherein the step of changing the grayscale phase of the current pixel further comprises:

changing the grayscale phase of the current pixel to the second grayscale phase if the current pixel is the first grayscale phase; and changing the grayscale phase of the current pixel to the first grayscale phase if the current pixel is the second grayscale phase.

6. The method of claim 5, wherein the first grayscale phase is achieved by applying successively a plurality of pulses, and the second grayscale phase is achieved by applying the pulses in a plurality of batches.

7. The method of claim 5, wherein the second grayscale phase is achieved by applying successively a plurality of pulses, and the first grayscale phase is achieved by applying the pulses in a plurality of batches.

8. A method for reducing dynamic false contour on a plasma display, executed by the plasma display, comprising the following steps:

determining a grayscale phase of a current pixel of the plasma display, comprising the following three steps:

using a first grayscale phase if the current pixel is the first pixel of the first frame field;

using a grayscale phase other than that of the first pixel of the previous frame field if the current pixel is the first pixel of a frame field other than the first frame field; and using a grayscale phase other than that of the previous pixel if the current pixel is other than the first pixel of a frame field;

changing the grayscale phase of the current pixel if one of N pixels in the same row before the current pixel has the same grayscale value and the same grayscale phase as those of the current pixel, wherein N is an integer equal to or greater than 2; and outputting the current pixel on the plasma display.

9. The method of claim 8, wherein the grayscale phases of the current pixel comprises the first grayscale phase and a second grayscale phase.

10. The method of claim 8, wherein N is 5.

11. The method of claim 8, wherein the step of changing the grayscale phase of the current pixel further comprises:

changing the grayscale phase of the current pixel to a second grayscale phase when the current pixel is in the first grayscale phase; and changing the grayscale phase of the current pixel to the first grayscale phase when the current pixel is in the second grayscale phase.

12. The method of claim 11, wherein the first grayscale phase is achieved by applying successively a plurality of pulses, and the second grayscale phase is achieved by applying the pulses in a plurality of batches.

13. The method of claim 11, wherein the second grayscale phase is achieved by applying successively a plurality of pulses, and the first grayscale phase is achieved by applying the pulses in a plurality of batches.

* * * * *